United States Patent [19]

Tietjens

[11] Patent Number: 4,882,840

[45] **Date of Patent: * Nov. 28, 1989**

[54] DRY-SHAVING APPARATUS

[75] Inventor: Eduard W. Tietjens, Eindhoven, Netherlands

[73] Assignee: U.S. Philips Corp., New York, N.Y.

[ * ] Notice: The portion of the term of this patent subsequent to Nov. 24, 2004 has been disclaimed.

[21] Appl. No.: 226,564

[22] Filed: Aug. 1, 1988

[30] Foreign Application Priority Data

Apr. 8, 1986 [NL] Netherlands ..... 8600878

[51] Int. Cl.[4] ..... B26B 19/04

[52] U.S. Cl. ..... 30/43.6; 30/346.51

[58] Field of Search ..... 30/43.3, 43.4, 43.5, 30/43.6, 346.51, 346.53, 346.58, 34.2

[56] References Cited

U.S. PATENT DOCUMENTS

| | | | |
|---|---|---|---|
| 3,890,709 | 6/1975 | Tietjens | 30/43.6 |
| 4,283,849 | 8/1981 | Engelhardt | 30/43.6 |
| 4,336,650 | 6/1982 | Gorter | 30/43.6 X |
| 4,490,907 | 1/1985 | Benedictus | 30/34.2 |
| 4,707,923 | 11/1987 | Tietjens | 30/43.6 |

*Primary Examiner*—Douglas D. Watts
*Assistant Examiner*—Rinaldi Rada
*Attorney, Agent, or Firm*—Ernestine C. Bartlett

[57] ABSTRACT

A dry-shaving apparatus comprises an external shear member formed with hair-entry apertures and an associated internal shear member rotatably drivable relative to the external shear member. The internal shear member includes a carrier, a cutter provided with a cutting edge, and a resilient element acting between the carrier and the cutter. At least a part of the cutter is movable against the action of the resilient element in a direction substantially opposed to the direction of driving the internal shear member.

13 Claims, 3 Drawing Sheets

DRY-SHAVING APPARATUS

This is a continuation of application Ser. No. 035,101, filed Apr. 6, 1987 now abandoned.

This invention relates to a dry-shaving apparatus comprising an external shear member formed with hair-entry apertures and an associated internal shear member which can be driven relative to the external shear member and which includes a carrier and at least one cutter provided with a cutting edge.

Such a dry-shaving apparatus is known, for example from U.S. Pat. No. 3,890,709.

It is the object of the present invention to improve the shearing action of such a shaving apparatus and to this end the invention is characterized in that the cutter is provided with a resilient element, at least a part of the cutter being movable against the action of the resilient element in a direction substantially opposed to the direction of driving the internal shear member.

The invention will now be described in more detail with reference to the accompanying drawings, in which.

Figure 1:
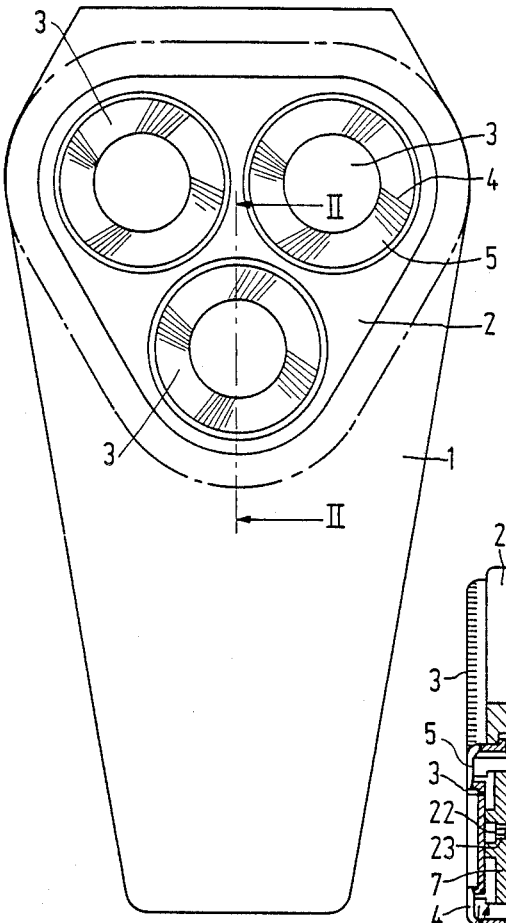
FIG. 1 is an elevational view of a dry-shaving apparatus having three external shear members.
Figure 2:
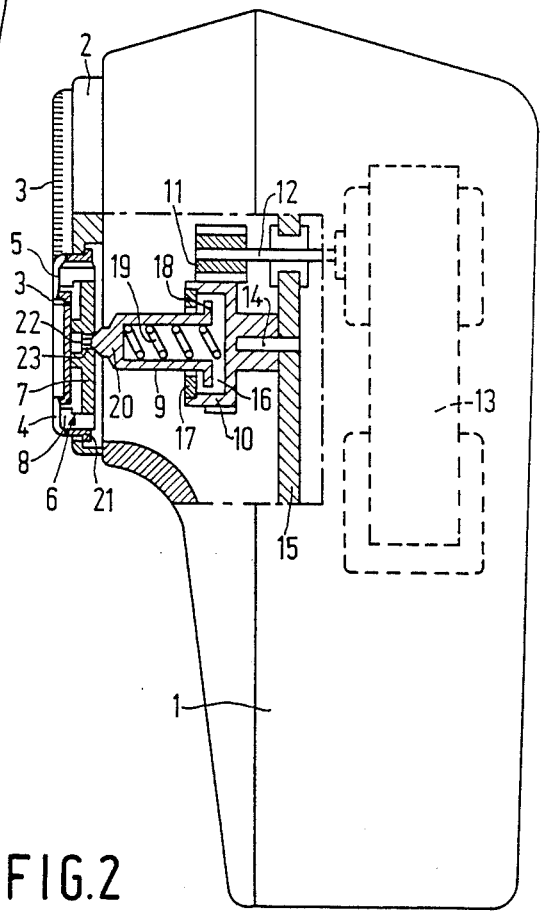
FIG. 2 shows the dry-shaving apparatus of FIG. 1 in a side view partly in section taken on the line II—II in FIG. 1.

The dry-shaving apparatus as shown in FIGS. 1 and 2 comprises a housing 1 of which a part is constructed as a holder 2 for three external shear members 3. The shear members 3 are formed with hair-entry apertures 4 in the form of slits, represented as single lines in FIG. 1 and situated in an annular shaving portion 5 of the external shear member.

As shown in the partly sectional view of FIG. 2, an internal shear member 6 is arranged on the inner side of each external shear member 3. This internal shear member 6 mainly comprises a carrier 7 and cutters 8 which extend axially towards the shaving portion 5.

The internal shear member 6 is coupled to an electric motor 13 by means of a hollow spindle 9 (FIG. 2), gear wheels 10 and 11 and a shaft 12, so that this internal shear member is rotatable relative to the associated external shear member 3. The gear wheel 10 is rotatably journalled on a pin 14 which is secured in a mounting plate 15. This gear wheel is formed with a recess 16 which is closed by a cover plate 17. This recess is engaged by a flange 18 at the end of the hollow spindle 9. By giving the flange 18 a non-round, for example square, shape and by giving the recess 16 a corresponding shape a coupling is obtained to transmit the rotation of the gear wheel 10 to the spindle 9. The spring 19, which is largely situated inside the hollow spindle 9 and which is compressed between the hollow spindle 9 and the gear wheel 10, exerts on the spindle 9 a force which is directed towards the internal shear member 6. Since the cylindrical portion 20 of the spindle 9 bears against the internal shear member 6 this force is transmitted to this shear member and to the external shear member 3 via this internal shear member 6, causing the external shear member 3 to be urged against the holder 2 having the flange 21. The shear members 3 and 6 together with the spindle 9 may be pressed inwards against the action of the spring 19 by external forces which may be produced during use of the dry-shaving apparatus.

The coupling for transmitting the rotary movement between the spindle 9 and the internal shear member 6 is obtained in that the spindle 9 is provided with an end portion 22 of rectangular cross-section. This end portion 22 engages a corresponding rectangular coupling aperture 23 in the shear member 6.

The coupling to the electric motor 13 as described above is identical for the three internal shear members 6 of the apparatus shown in FIGS. 1 and 2, the three gear wheels 10 being in mesh with a single central gear wheel 11 on the motor shaft 12.

Figure 3:
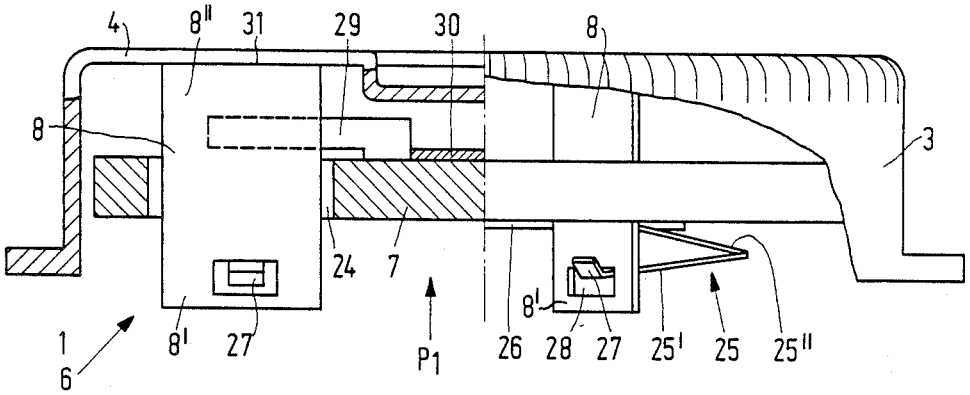
FIG. 3 shows diagrammatically on an enlarged scale a combination of an internal shear member and an external shear member, the left-hand half being a sectional view and the right-hand half being a view in which the external shear member is partly cut away.
Figure 4:
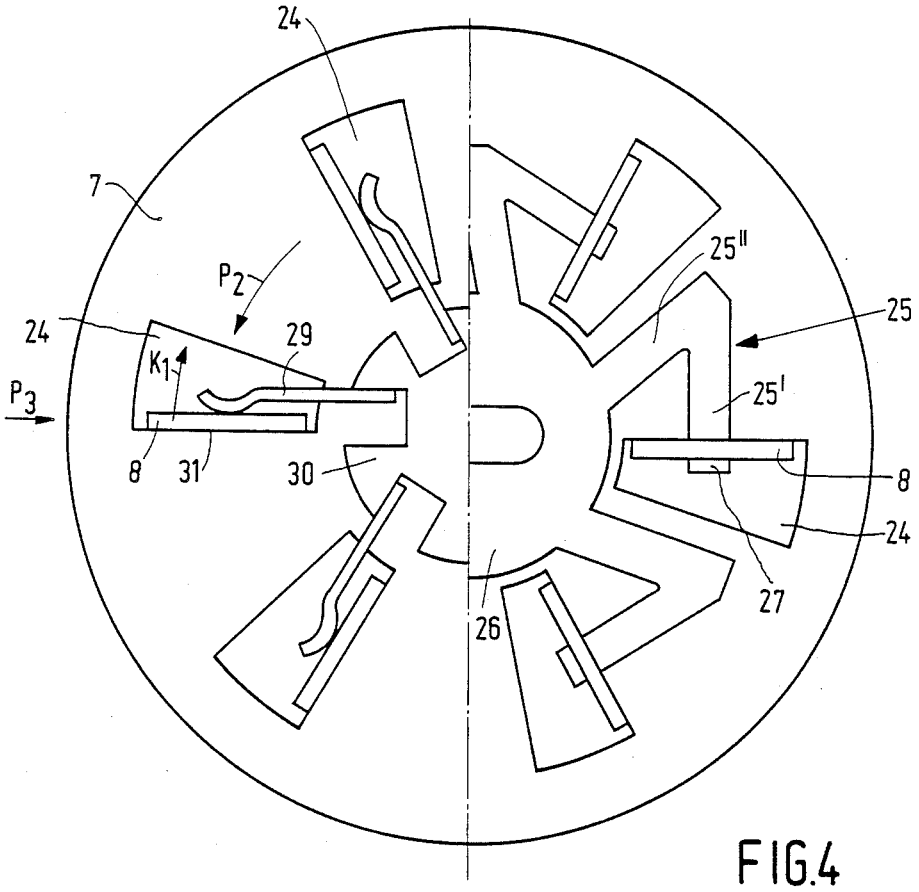
FIG. 4 shows in the left-hand half a top plan view and in the right-hand half a bottom plan view of the internal shear member of FIG. 3.

In the combination of an external shear member 3 and an internal shear member 6 as shown in FIGS. 3 and 4 the internal shear member 6 includes a disk-shaped carrier 7 with openings 24 in which the cutters 8 are disposed. In the axial direction, indicated by the arrow $P_1$ the cutters 8 are respectively loaded by resilient arms 25 which form part of a resilient body 26 which is secured to the underside of the carrier 7. The ends 27 of the resilient arms 25 are hook-shaped and engage openings 28 in the lower end portions 8' of the cutters 8. The resilient arms are V-shaped and comprise limbs 25' and 25''.

At the upper side of the carrier 7 each cutter 8 is provided with a resilient element 29 which acts between the carrier 7 and the cutter 8 and resiliently supports the cutter substantially in the direction of driving $P_2$. The resilient elements 29 are constructed as blade springs and are integral with a central body 30 of a sheet material which is secured to the upper side of the carrier 7.

During use of the apparatus, when a hair is caught in a hair-entry aperture 4 the cutting edge 31 on the upper end 8'' of a cutter 8 will penetrate the hair and the hair will be severed by cooperation of the cutter 8 and the external shear member 3. The force produced during cutting includes a component $K_1$ which acts on the cutter 8 in a direction substantially opposed to the direction of driving $P_2$. This force $K_1$ is capable of pivoting the cutter about the end 27 of the resilient arm 25. As a result the upper end 8'' of the cutter 8 will be moved relative to the carrier against the action of the resilient element 29 in the direction of force $K_1$, i.e. in a direction substantially opposed to the direction of driving $P_2$. For this purpose the openings 24 in the carrier 7 are made sufficiently large. After the hair has been severed the cutter 8 is urged back into the original position shown in FIGS. 3 and 4 by the resilient element 29.

This arrangement enables inertial forces occurring during cutting of a hair to be reduced, so as to smooth out load surges to which the motor and the drive mechanism between the motor and the internal shear member 6 are subjected. The above construction counteracts the occurrence of undesired vibrations, provides a smoother operation of the apparatus, and prolongs the life of the moving parts. After a hair has been severed the pressure exerted by the resilient element 29 ensures an accelerated return of the cutter 8 to the position shown in FIGS. 3 and 4. As a result of this accelerated return of the cutter 8 the severed hair which is situated before the cutter is propelled away, so that the internal shear member 6 tends to be soiled less rapidly.

Figure 5:
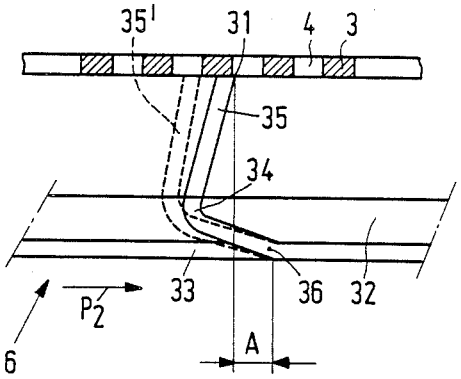
FIG. 5 shows on a further enlarged scale a part of a combination of an internal shear member and an external shear member in another embodiment.
Figure 6:
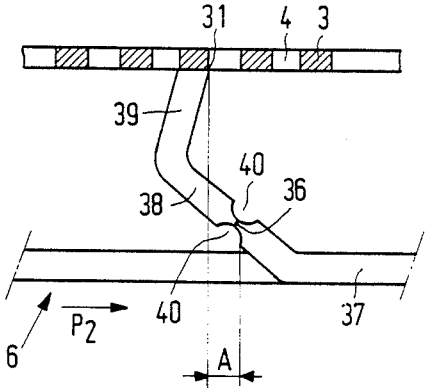
FIG. 6 shows on a further enlarged scale a part of a combination of an internal shear member and an external shear member in yet another embodiment.
Figure 7:
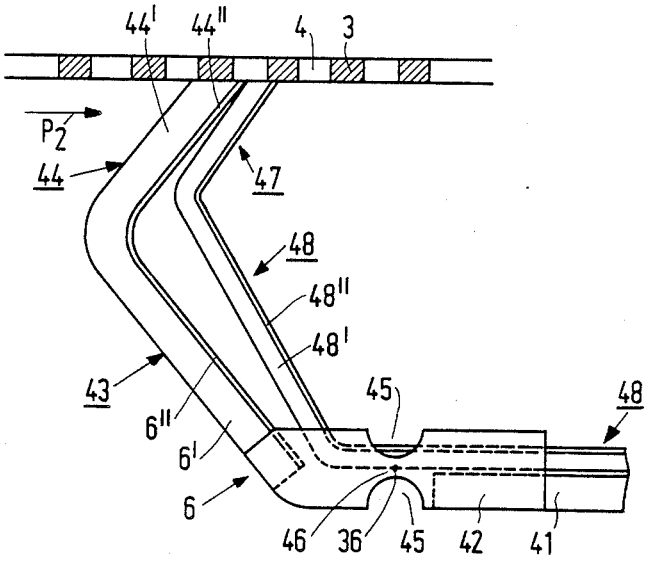
FIG. 7 shows on a further enlarged scale a part of a combination of an internal shear member, an external shear member and a hair-pulling element.

FIGS. 5, 6 and 7 show simplified radial side views taken on the line $P_3$ in FIG. 4 of several modifications of the internal shear member 6 in conjunction with sectional views of the external shear member 3 having the hair-entry apertures 4.

The internal shear member shown in FIG. 5 includes a carrier 32, which is made of for example a plastic, and a part 33 made of sheet metal. Arms 34 repectively carrying the cutters 35 at their ends are bent out of the plane of the sheet-metal part 33. The arms 34 also constitute the resilient elements, so that the cutters 35 are deflexible in a direction substantially opposed to the direction of driving $P_2$, as is indicated in broken lines by the reference numeral 35' in FIG. 5. This deflection of the cutter 35 may be regarded as an approximation to a rotation about an axis of rotation 36.

In the embodiment shown in FIG. 6 the carrier is constructed as a suitable metal plate 37. The arms 38 carrying the cutters 39 at their respective ends are bent out of the plane of the plate 37. By forming opposed recesses 40 in each arm 38 an elastic pivot is formed at this location. The deflection of the cutter 38 relative to the carrier 37 may again be regarded as an approximation to a rotation about an axis of rotation 36 between the recesses 40. Viewed in the direction of driving, the cutting edge 31 in the embodiments shown in FIGS. 5 and 6 is situated at a distance A behind such axis of rotation 36, so that no additional forces occur between the internal shear member 6 and the external shear member 3 if during cutting of a hair the cutter 35 or 38 is moved in a direction opposite to the direction of movement $P_2$ relative to the carriers 33 and 37 respectively as a result of the rotation about such axis of rotation 36.

FIG. 7 shows an example of an internal shear member 6 including a carrier 41 having a wall portion 42 which is adjoined by an arm 43. The outer end of the arm 43 carries the cutter 44. By forming recesses 45 in the wall portion 42 an elastic pivot having an axis of rotation 36 is formed at the location 46. In a manner as known, for example, from U.S. Pat. No. 3,962,784 the cutter 44 is provided with a hair-pulling element 47 which forms part of a hair-pulling member 48. The elastic pivot 46 constitutes the resilient element under the influence of which the cutter 44 can deflect in a direction substantially opposite to the direction of movement $P_2$.

The accelerated return of the cutter under the influence of the resilient element as described in the foregoing is of particular importance in constructions including hair-pulling elements because the severed hair, which is situated in front of the cutter or which has adhered to the hair-pulling element, can be propelled away. Therefore the rate of soiling is reduced substantially in such constructions.

The internal shear member 6 is made of a laminated material, for example a plastic layer 6' and a metal layer 6''. Cutter 44 may similarly be made of a plastic layer 44' and a metal layer 44''. This enables friction losses between the internal shear member and the external shear member to be reduced, whilst the damping properties of the plastic further counteract vibrations. The hair-pulling member 48 may also be manufactured from a laminated material comprising a plastic layer 48' and a metal layer 48''. This enables the thickness of the hair-pulling element 47 to be increased, thereby improving the action of the hair-pulling element.

What is claimed is:

1. A dry-shaving apparatus comprising an external shear member formed with hair-entry apertures and an associated internal shear member rotatably drivable relative to the external shear member; said internal shear member including a carrier, a hair-severing cutter provided with a cutting edge, and a resilient element acting between the carrier and the cutter, at least a part of the cutter being movable against the action of the resilient element in a direction substantially opposed to the direction of driving the internal shear member.

2. A dry-shaving apparatus as claimed in claim 1, in which the resilient element is constructed as a blade spring.

3. A dry-shaving apparatus as claimed in claim 2, in which the blade spring is integral with a central part of a sheet material secured to the carrier.

4. A dry-shaving apparatus as claimed in claim 1, in which the cutter includes a connecting arm having one end secured to the carrier, the connecting arm being formed as the resilient element.

5. A dry-shaving apparatus as claimed in claim 4, in which the connecting arm is provided with oppositely disposed recesses, an elastic pivot thereby being provided in the connecting arm at the location of said recesses.

6. A dry-shaving apparatus as claimed in claim 1, in which the cutter is rotatable relative to the carrier about an axis of rotation, and the cutting edge of the cutter is situated behind the axis of rotation viewed in the direction of driving the internal shear member.

7. A dry-shaving apparatus as claimed in claim 1, in which the cutter is made of a laminated material comprising a metal layer forming the cutting edge and a plastic layer having vibration-damping properties.

8. A dry-shaving apparatus as claimed in claim 1, in which a hair-pulling element is associated with the cutter and is positioned before said cutter in the direction of driving the internal shear member.

9. A dry-shaving apparatus as claimed in claim 8, in which the hair-pulling element is made of a laminated material comprising a metal layer and a plastic layer.

10. A dry-shaving apparatus comprising an external shear member formed with hair-entry apertures and an associated internal shear member rotatably drivable relative to the external shear member; said internal shear member including at least one hair-severing cutter with a cutting edge effective to sever a hair in cooperation with the external shear member, a carrier having an upper side and an underside and with one or more openings in which one or more of said cutters are disposed, said cutters being loaded by parts of a resilient body secured to the underside of said carrier, and the upper side of said carrier having a resilient element which acts between the carrier and the cutter, at least a part of said cutter being movable against the action of said resilient element in a direction substantially opposed to the direction of driving the internal shear member.

11. A dry-shaving apparatus as claimed in claim 10 in which the resilient element is a blade spring and said parts of the resilient body comprise V-shaped arms.

12. A dry-shaving apparatus comprising an external shear member formed with hair-entry apertures and an associated internal shear member rotatably drivable relative to the external shear member; said internal shear member including a carrier; at least one cutter having a cutting edge adapted to sever hair and a connecting arm secured at one end to the carrier; said connecting arm forming a bent resilient element acting between the carrier and the cutter, said cutter being movable in a direction substantially opposite to the direction of driving the internal shear member.

13. A dry-shaving apparatus comprising an external shear member formed with hair-entry apertures and an associated internal shear member rotatably drivable relative to the external shear member; said internal shear member including a carrier; at least one cutter having a cutting edge adapted to sever hair and a connecting arm secured at one end to the carrier; said connecting arm forming a resilient element acting between the carrier and the cutter and being provided with oppositely disposed recesses forming an elastic pivot, said cutter being movable in a direction substantially opposed to the direction of driving the internal shear member.

* * * * *